US011450299B1

(12) United States Patent
Ruprecht

(10) Patent No.: US 11,450,299 B1
(45) Date of Patent: Sep. 20, 2022

(54) PNEUMATIC RETURN FOR FOOT PEDALS ASSOCIATED WITH PERCUSSION INSTRUMENTS

(71) Applicant: David S Ruprecht, Parma, OH (US)

(72) Inventor: David S Ruprecht, Parma, OH (US)

( * ) Notice: Subject to any disclaimer, the term of this patent is extended or adjusted under 35 U.S.C. 154(b) by 0 days.

(21) Appl. No.: 17/494,004

(22) Filed: Oct. 5, 2021

(51) Int. Cl.
*G10D 13/11* (2020.01)

(52) U.S. Cl.
CPC ..... *G10D 13/11* (2020.02)

(58) Field of Classification Search
CPC ..... G10D 13/11; G10D 13/00; G10D 13/10; G10D 13/01
See application file for complete search history.

(56) References Cited

U.S. PATENT DOCUMENTS

| | | | | |
|---|---|---|---|---|
| 4,945,802 | A | 8/1990 | Ruprecht | |
| 6,903,257 | B2 | 6/2005 | Yun | |
| 2005/0016358 | A1* | 1/2005 | Wise | G10D 13/11 84/422.1 |

* cited by examiner

*Primary Examiner* — Kimberly R Lockett
(74) *Attorney, Agent, or Firm* — Kathryn Perales

(57) ABSTRACT

This improvement to a pneumatic return mechanism for percussion foot pedals incorporates a flat or bowl-shaped diaphragm rather than a rolling diaphragm, and a piston which is spherical rather than cylindrical, producing a bouncy feel for the player. A further improvement to the track hub of a percussion foot pedal enables bump fasteners to be removably inserted, to add lift and alter beater acceleration. A further improvement is a removable stiffener which prevents slack in the connector between the footboard and track hub of the percussion foot pedal, which may occur during fast drumming.

9 Claims, 8 Drawing Sheets

PNEUMATIC RETURN FOR FOOT PEDALS ASSOCIATED WITH PERCUSSION INSTRUMENTS

BACKGROUND OF THE INVENTION

The inventor received U.S. Pat. No. 4,945,802 in 1990 for a "Pneumatic Return for Foot Pedals Associated with Percussion Instruments" (the "1990 invention.") The 1990 invention is an alternative return mechanism for bass drum pedals and hi-hat stand pedals, which uses a pneumatic device to return the footboard of the pedal and connected drum beater or cymbal to a neutral position after each strike, instead of a traditional spring mechanism.

Springs had been and continue to be widely used for this purpose, though they have problems. For example, coil springs tend to lose their elasticity over time. They also tend to be noisy, are not easily calibrated, and fail over time. In order to obtain a different feel, for example with regard to movement, resistance to movement, beater bar speed, or timing, one must usually purchase an entire new pedal assembly. Substitution of different size springs, where possible, can be a time-consuming chore.

The 1990 invention enabled a drummer to effect precise and repeatable settings and adjustments, to thereby achieve a smooth, quiet and unique "feel," without most of the disadvantages of the known coil spring-controlled systems. The 1990 invention also permitted several additional adjustments for varying operating characteristics, which were previously only possible by switching to a separate pedal assembly.

In August 2015, U.S. Pat. No. 9,099,060 was awarded to Van Dyk as a second alternative to the traditional spring return mechanism for a bass drum pedal. This invention incorporates the use of opposing magnets to provide a return force to the drum beater, replacing the spring.

The 1990 invention uses a rolling diaphragm and a cylindrical piston. While these work well, there is room for improvement—for example, the rolling diaphragm tends to fail after many uses, likely due to friction, distortion and side loads. Typically, a pneumatic drum pedal of the 1990 invention's design has been found by the inventor to have approximately one half of the useful cycle life of a traditional spring return mechanism. In another example, pneumatic means using a cylindrical piston necessarily requires the piston to remain in a position which is almost perfectly parallel to the axis of the cylinder into and through which it travels, so as to minimize (and ideally prevent) friction. This necessitates the connection between the piston rod and the actuator to have at least two pivot points, and also necessitates use of a linear bearing to keep the piston rod and piston in dead center of the cylinder. The two pivot points are each potential friction or failure points, and the linear bearing introduces friction as well.

The 1990 invention, and other drum pedals, utilize a track hub around which a chain is guided in a groove as it connects the footboard and the beater. This track hub may be a true center track, or a cam of various shapes. The track hub is a permanent part of the drum pedal mechanism and in most cases is not interchangeable.

The 1990 invention, and other drum pedals, commonly utilize a flexible chain, strap or belt as part of the connection between the drum beater and the pedal. This flexible connector can become momentarily slack and loose at certain times during use, which greatly affects the feel and playability of the pedal. When slack is introduced in the chain, strap or belt, the footboard is no longer following the exact motion of the beater, and this can be a problem when playing at a fast tempo.

Some specialized drum pedals use a hard, non-flexible link which eliminates the slackness problem. Solid link pedals have a distinct difference in feel and playability from pedals which use a flexible link. Solid link pedals tend to be better suited for very fast "Speed Metal" type playing situations, while the chain or strap provides a lighter, more sensitive feel which is preferred by many drummers.

BRIEF DESCRIPTION OF THE INVENTION

Inventor has developed a solution to the problem of eventual failure of the rolling diaphragm in the 1990 invention, and in the process has discovered and developed related improvements.

Conventional wisdom dictates that in order to provide sufficient pneumatic force, and displace an appropriate volume of air, the cylinder containing the compression chamber must have a minimum length, and the piston must have a minimum travel distance within the cylinder. The size, configuration and footprint of the various parts of a drum pedal constrain the possible size, shape and configuration of the pneumatic return assembly. These constraints contribute to the failure of the rolling diaphragm, because the rolling diaphragm's radius must be small, and the work performed each time during inversion through the convolute is substantial.

Use of a flat diaphragm with a spherical piston retains all of the benefits of the 1990 invention, while improving reliability and reducing friction. The hemispherical shape of the portion of the piston surface which contacts the diaphragm over the course of its travel results in an exponential increase in displacement volume within the cylinder, as a function of linear travel of the piston along the axis of the cylinder, between the position where the spherical piston contacts the diaphragm at one point, and the position where all of the bottom half of the spherical piston presses against the diaphragm. This exponential change in displacement, as opposed to the geometric change in displacement experienced with a cylindrical piston, causes a "bouncy" feel at the beginning of each return motion, with the greatest return force and return speed being experienced at the beginning of the return motion. This bouncy feel is unique and desirable for playability, and has not previously been possible to implement with spring technology or a pneumatic setup using a rolling diaphragm.

As compared to a cylindrical piston moving inside and along the axis of a cylinder, this new configuration, of the spherical piston and a flat diaphragm, allows much more variation in the lateral position and rotational position of the piston in relation to the diaphragm and cylinder. The uniformly spherical shape of the piston, regardless of its rotation or orientation, makes it unnecessary to constrain or control the piston's rotation. In addition, the uniformly flat shape of the diaphragm makes the exact location of the piston's resting place on the diaphragm unimportant.

The spherical piston may be attached to the diaphragm, for example with a spot of glue, or with a screw or bolt type of fastener that is fastened well enough to keep the diaphragm airtight; or it may simply rest on top of the diaphragm. Being mechanically attached to the flat diaphragm does not prevent the piston from rotating.

The flat diaphragm has material properties and durometer that permit a limited amount of elastic deformation when under working pressures. This elastic deformation provides the additional piston stroke length required, while eliminating the need for the diaphragm to travel through a convolute typical of a rolling diaphragm, thus eliminating the failure modes experienced with the rolling diaphragm. The flat diaphragm follows a "trampoline" type motion vs. a rolling diaphragm inversion motion.

Each of these points make it possible to use a single connecting rod between the pedal's main rotating axle and piston rod with only one pivot/bearing located at the top of the connecting rod, attaching the connecting rod to the rotational motion of the beater axle. This reduced complexity and reduced number of moving parts is good for reliability and longevity, and reduces friction and the number of possible failure points, improving overall pedal playability.

Inventor has further developed a new solution for adjusting the feel and return speed of the drum pedal, by making the cam shape of the track hub adjustable, instead of having to switch to a different pedal.

The improved cam shaped track hub has one or more holes which pass through the cam perpendicularly to the path of the groove and chain track, directly through the walls of the groove portion of the track hub that receives the chain. Each pair of holes can receive a fastener which removably attaches through the holes to the cam shaped track hub, and produces a hump in the track, which the chain then travels over. This alters the shape of the cam and the track, which in turn affects the position on the track hub where beater return acceleration is aided by providing additional "lift" from the cam. The exact position of where, in the return stroke of the pedal, the additional "lift" occurs is dependent on which of the provided pairs of holes the added fastener is positioned.

Inventor has further developed a new solution for preventing slack in the flexible chain or strap that connects the footboard to the track hub, or in the case of the hi-hat stand, to the rod which provides vertical motion to the top hi-hat cymbal. No longer is it necessary to switch to a different drum pedal or hi-hat with a non-flexible connector. The solution is a flat, straight, stiff piece of material that can be removably attached to a portion of the flexible connector that never contacts the drive hub, forcing that portion of the connector to stay rigid while being played, eliminating any slack that can alter the feel and playability of the pedal. The material can be C-channel shaped or flat, and attached with bolts or other fasteners; it can be attached with claw-like tabs that reach around the outside of the chain, or with claw-like tabs that pass through the chain, or with clips that securely grab the strap. In one embodiment, two similar pieces of flat material are placed on the chain, one on either side, and bolted together through the chain.

Other objects and advantages of the invention will become apparent from the detailed description which follows.

DETAILED DESCRIPTION OF THE INVENTION

Figure 1:
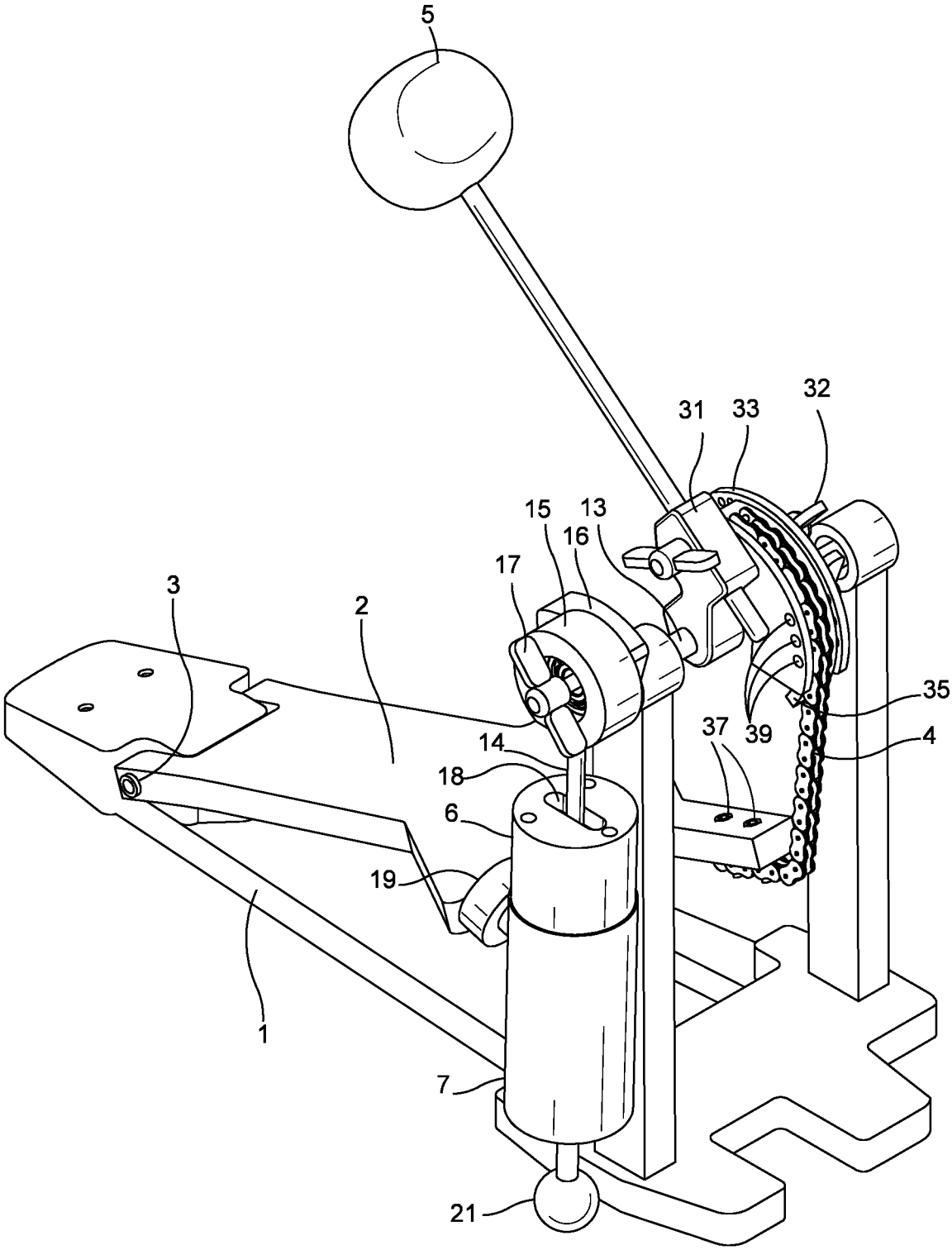
FIG. 1 is an oblique view of an entire drum foot pedal assembly provided with a pneumatic return in accordance with the invention.

We begin by referring to FIG. 1, which shows a drum pedal with pneumatic return which incorporates the improvements to the pneumatic return herein described. The basic parts of any drum pedal assembly include a base 1, which rests on the floor and provides stability and a foundation; a footboard 2, which is connected to the base 1 with a hinge 3; a connector such as a chain 4, strap or rod which connects the footboard 2 to a rotating beater mechanism; and a return mechanism. Assuming that the drum pedal assembly is positioned appropriately and close enough to a drum, then when the footboard 2 is pressed downward with the force of a drummer's foot, the hinge 3 acts as a fulcrum, and the connector 4 is pulled downward, pulling on the beater mechanism and causing it to rotate, such that the end of the beater 5 itself travels in an arc and eventually strikes the drum.

When the drummer releases force from the footboard 2, the return mechanism operates to pull the beater 5 immediately away from the drum and eventually back to a neutral position.

FIG. 1 illustrates an exemplary drum pedal assembly which incorporates the pneumatic return improvement. Some key components of the improvement are hidden inside the cylinder assembly 6, 7, and shown in FIGS. 2, 3A and 3B. As in the 1990 invention, the pneumatic return assembly is made up of a cylinder of two outer pieces—a cap 6, which is not sealed and where the piston 8 is housed; and the body 7 of the cylinder, the top part of which houses a sealed compression chamber 9. The diaphragm 10 is securely and air-tightly attached around its circumference between the cylinder cap 6 and body 7. In the embodiment shown in FIG. 1, the cylinder cap 6, diaphragm 10 and cylinder body 7 are secured with bolts 11. The diaphragm 10 may optionally be attached to the end of the piston 8 with glue, or with a bolt or screw which passes through a hole in the center of the diaphragm 10 and is screwed tightly into the end of the piston 8 to make an air-tight connection, as shown in the figures for the 1990 invention.

Figure 2:
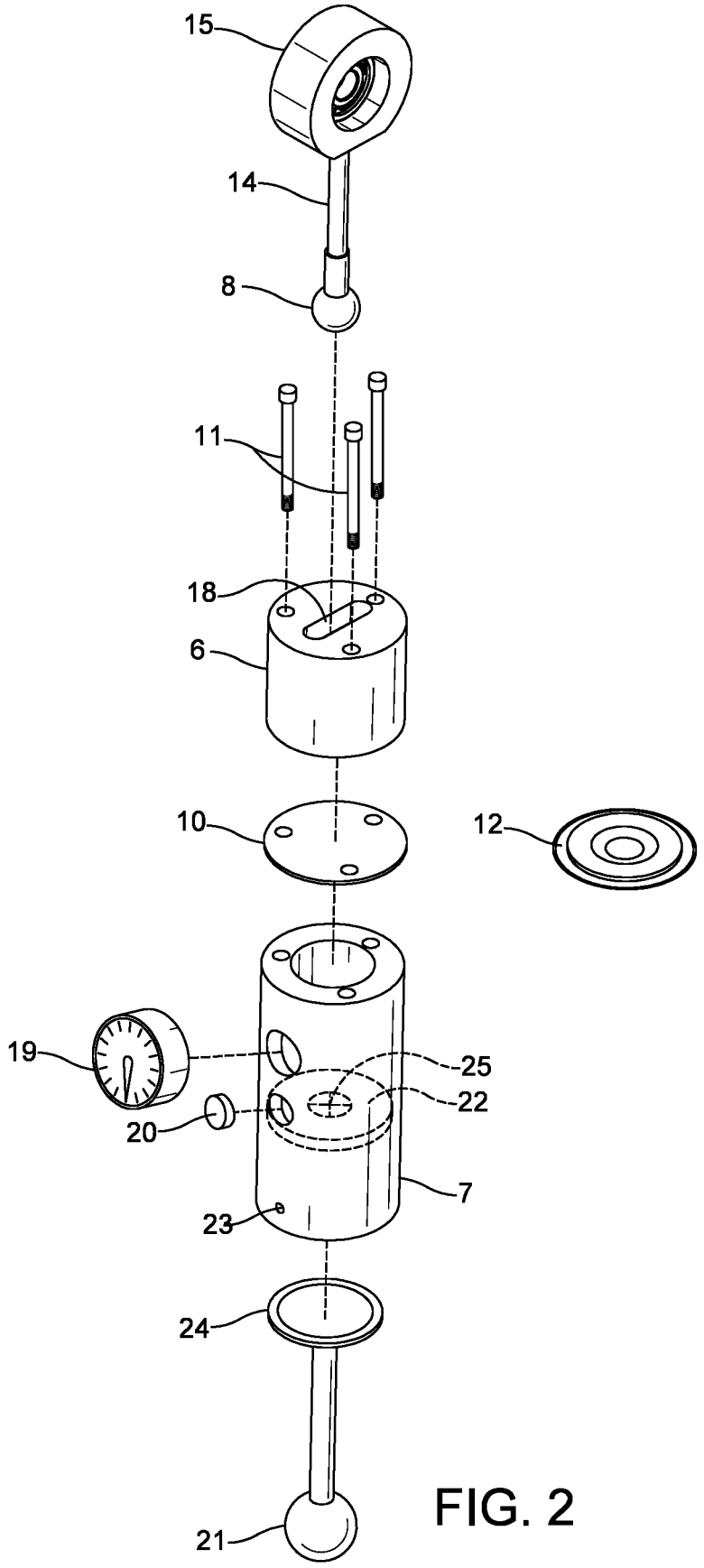
FIG. 2 is an exploded view of a pneumatic return mechanism in accordance with the invention, and also shows an alternative diaphragm which may be used instead of a flat diaphragm.

A key improvement over the 1990 pneumatic return assembly is the use of a flat diaphragm 10, rather than a rolling diaphragm. In a preferred embodiment, the flat diaphragm 10 is cut into a circular shape from a 1/16 inch or 1.5 mm thick piece of flat stock 60 durometer polyurethane. The flat diaphragm 10 could successfully be made from any similar material which is flexible, strong and gas-impermeable. While the perimeter of the diaphragm 10 will most commonly be circular, its perimeter can have any shape which is configured to fit into and make an airtight seal within a compression chamber. A diaphragm with a generally paraboloid or bowl-like shape, as shown in FIG. 2 as item 12, can also be used. The diaphragm may originally be installed with a bowl-like shape, or alternatively, after heavy use, an originally flat diaphragm may naturally stretch and distort into a bowl-like shape.

A second improvement to the 1990 pneumatic return assembly is the use of a spherical piston 8, rather than a cylindrical piston. Note that in the embodiment shown in FIGS. 2, 3A and 3B, the spherical piston 8 simply rests on the diaphragm 10, and is not attached to it. However, the spherical piston 8 and flat or bowl-shaped diaphragm 10, 12 also work well when they are attached with a spot of glue, or a screw, or with other means.

Figure 3B:
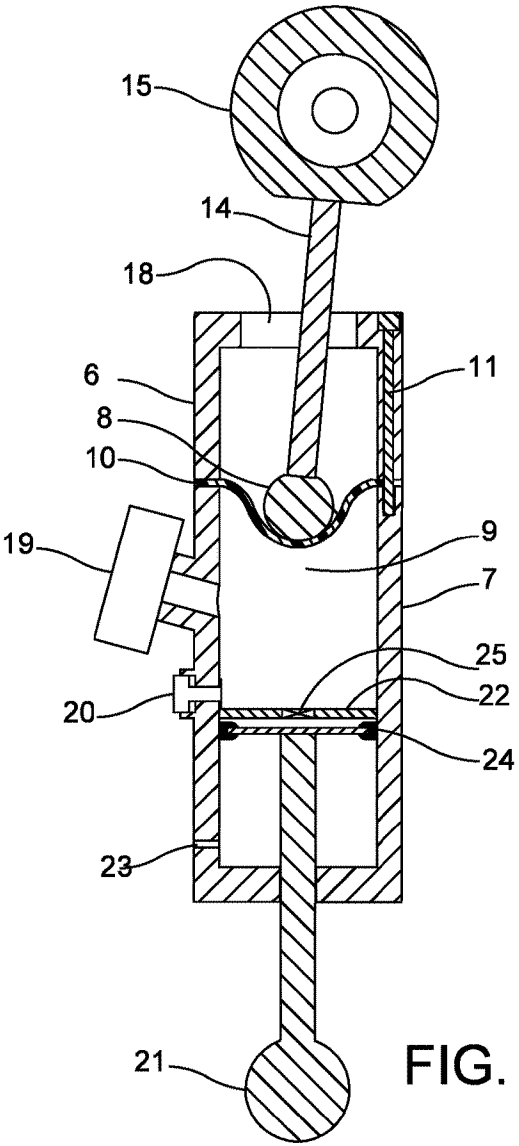
FIG. 3B is a cross-sectional side view of the pneumatic return mechanism shown in FIGS. 1, 2 and 3A, with the piston depressed into the diaphragm in a position which causes an increase in pneumatic pressure in the compression chamber.
Figure 3A:
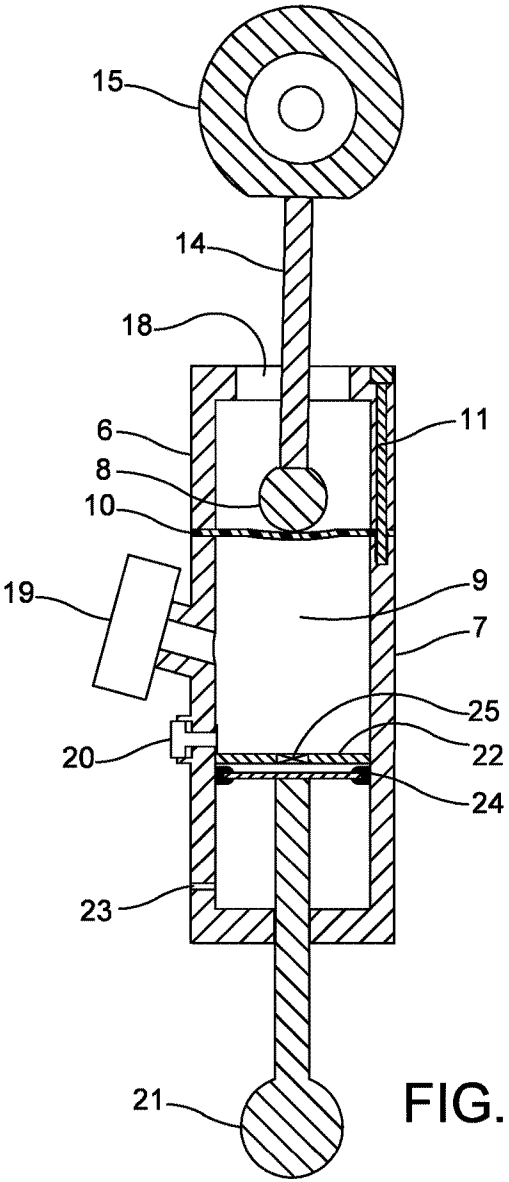
FIG. 3A is a cross-sectional side view of the pneumatic return mechanism shown in FIGS. 1 and 2, with the piston in neutral or resting position, not causing any additional pneumatic pressure in the compression chamber.

A third improvement is a linkage path between axle 13 and piston 8 which has only one pivot point. As shown in FIGS. 1, 3A and 3B, the piston 8, connecting rod 14 and bearing keeper 15 make up one rigid piece (the piston assembly,) wherein the piston 8 is located at one end of a connecting rod 14, and the opposite end of the connecting rod 14 is connected to the bearing keeper 15. As shown in FIG. 1, the bearing keeper 15 is rigidly attached to the connecting link 16 and axle 13 with a wing nut 17 in a position such that the piston assembly is offset from the axle 13 and travels in a modified arc, rather than simply rotating with the axle 13. The angle of inclination of the connecting rod 14 as compared to the floor rotates from perpendicular to slanted, as the piston assembly rotates and simultaneously travels downward toward the diaphragm 10. Note that the opening 18 in the cylinder cap 6 must be longer in one dimension from the center of the cylinder cap 6, so as to allow the connecting rod 14 to move laterally and change its angle of inclination as the piston assembly rotates. The piston 8 presses into the diaphragm 10, thereby compressing the air or other gas in the compression chamber 9.

When the drummer releases the force of their foot on the footboard 2, the compressed air inside the compression chamber 9 pushes back against the diaphragm 10 and piston 8 with its own pneumatic force, causing the piston assembly to travel back upwards, thus rotating the axle 13 through the linkage path, and ultimately causing the beater 5 to rotate back to a neutral position, away from the drum.

In the embodiment pictured in FIGS. 1, 2, 3A and 3B, a user/drummer may monitor and increase or decrease the pressure in the compression chamber 9. A pressure gauge 19 shows the psi present inside the compression chamber 9, in real time. Pressure may be decreased by activating the pressure release valve 20, allowing gas to escape from the compression chamber 9. Pressure may be increased by pumping the pump handle 21 up and down. When the pump handle 21 is pulled out to its farthest point from the divider 22, air enters the cylinder through the hole 23. When the pump handle 21 is pushed such that the O-ring assembly 24 travels toward the divider 22, air is forced through the check valve 25 in the center of the divider 22, into the compression chamber 9, thus increasing the pneumatic pressure inside the compression chamber 9.

Figure 4:
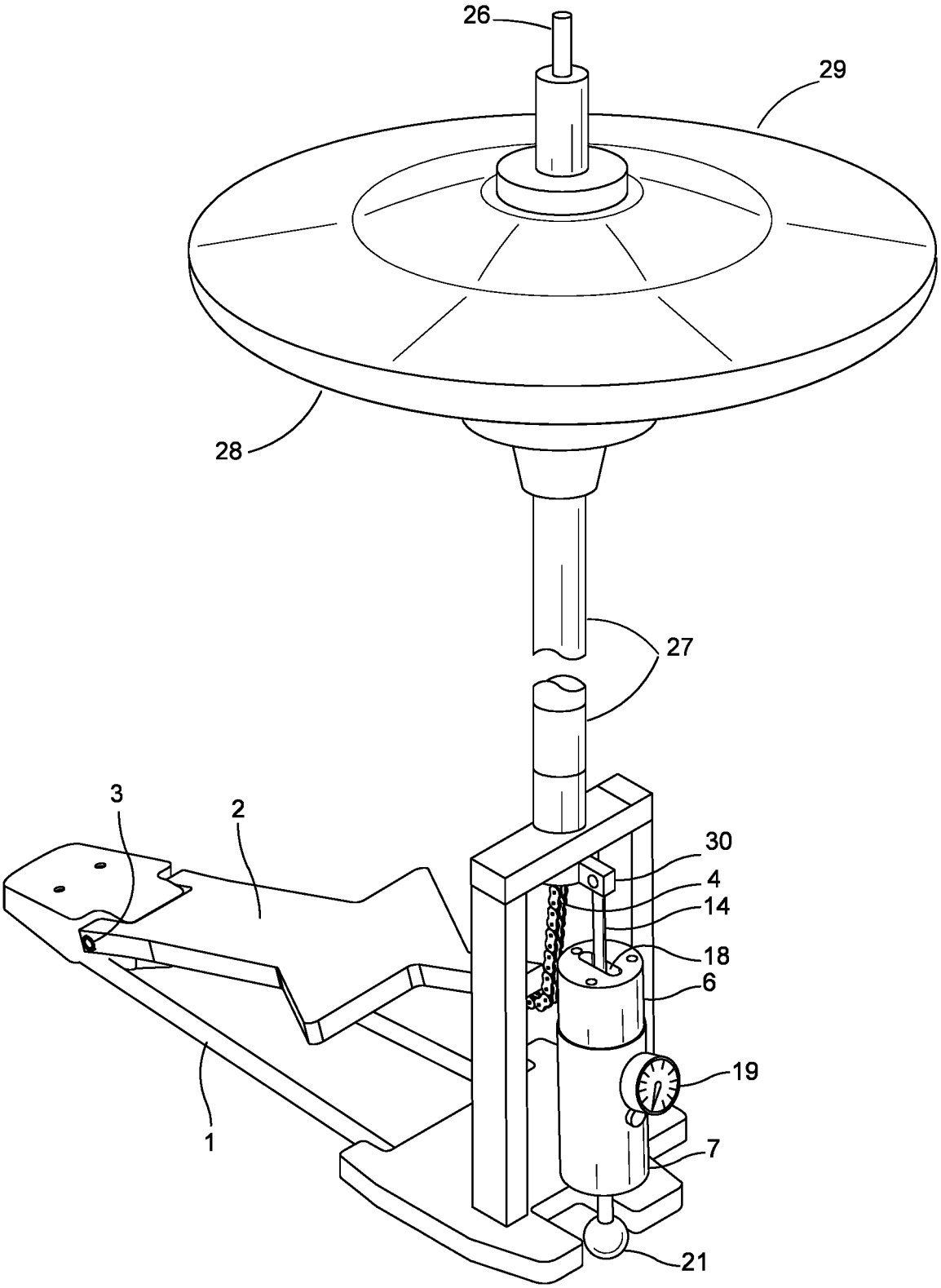
FIG. 4 is an oblique view of a hi-hat stand foot pedal assembly incorporating the improved pneumatic return mechanism.
Figure 5:
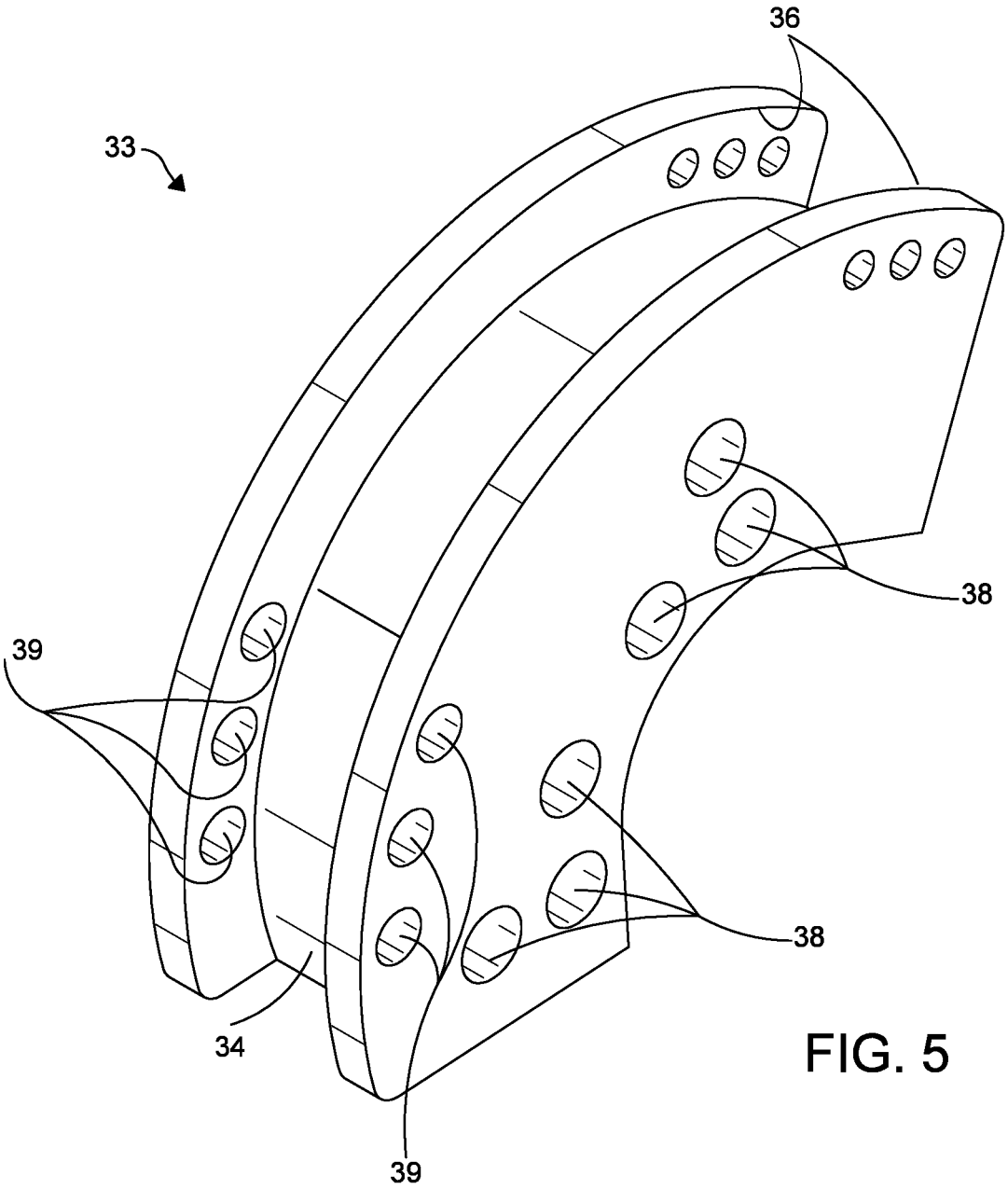
FIG. 5 is an oblique view of an improved cam-shaped track hub with two sets of holes for mounting the cam on the axle, and one set of holes for adjusting the shape of the track and chain which rides on the cam.

The improved pneumatic return may also be used with a hi-hat stand, such as that shown in FIG. 4, instead of a conventional spring return mechanism. A hi-hat stand differs from a drum pedal in that there is no rotating beater mechanism. Instead, the footboard 2 and connector 4 is attached to the lower end of a vertically extending actuator rod 26, which is housed inside a main vertical support member 27. A lower cymbal 28 is attached to the top of the stationary main vertical support member 27, and an upper cymbal 29 is attached to the top of the actuator rod 26. When a musician presses the footboard 2 downwards, the connector 4 pulls the actuator rod 26 downwards, and therefore the upper cymbal 29 moves downwards toward the lower cymbal 28.

FIG. 4 shows one way that the improved pneumatic return may be used with a hi-hat stand. Rigid offset connector 30 extends generally perpendicularly from the lower end of the actuator rod 26, and attaches to the top of the piston connecting rod 14. Pressing the footboard 2 downwards also causes the connecting rod 14 and piston (not shown) to press into the diaphragm (not shown) thereby compressing the air or other gas in the compression chamber 9.

When the musician releases force from the footboard 2, the gas inside the compression chamber 9 expands, causing the pneumatic return mechanism to push the upper cymbal 29 immediately away from the lower cymbal 28 and eventually back up to a neutral position.

Turning now to a description of an improved adjustable track hub, the exemplary rotating beater mechanism pictured in FIG. 1 consists of an axle 13, a beater mount 31, a beater 5 and a track hub 33, which are all rigidly connected to each other, for example with a wing nut 32. The track hub 33 has a peripheral groove 34, which is adapted to receive a layer of felt 35, and the connector 4 on top of the felt 35. The connector 4 is secured to one end 36 of the peripheral groove 34 of the track hub 33, continues along the entire peripheral groove 34, and then extends down and is secured to the elevated end of the footboard 2 with bolts 37 or other appropriate fasteners.

The improved track hub 33 pictured in FIGS. 1, 5, 6A, 6B, 7A and 7B is cam shaped, and may be mounted to the beater mount 31 using the mounting holes 38 in various ways as described in the 1990 patent, causing the track hub 33 to rotate as a true center sprocket, or as an eccentric or off-center hub for the chain 4 or strap to ride on during movement of the pedal.

The track hub 33 described herein is improved with the addition of one or more pairs of holes 39, each pair being situated on both walls of the groove 34, near the end of the groove 34 from which the connector 4 extends down to the footboard 2. Each pair of holes 39 can receive a bump fastener 40, which is a bolt that fits and attaches securely and rigidly through a pair of holes 39 on both walls of the groove 34, underneath the felt 35 and connector 4. The felt 35 then rests on top of the bump fastener 40 instead of resting on the floor of the groove 34, and the connector 4 rests on and travels over the felt 35. In this way, the bump fastener 40 adds a hump and adjusts the shape of the track hub 33 and its groove 34, so that the acceleration characteristics of the beater bar can be varied. This provides the ability to create additional lift at a specific desired point in the beater return travel path.

This disclosure now turns to an improvement to the connector 4 which connects the footboard 2 to the rotating beater mechanism in a drum pedal, or to the actuator rod 26 of a hi-hat stand. Under certain playing conditions, particularly very fast beats, the flexible connector 4 (which may be a chain or strap or other flexible material) may experience slack or looseness. Although this slack is momentary, it greatly affects the playability and feel of the drum pedal or hi-hat stand. When slack is introduced in the connector 4, the footboard 2 is no longer following the exact motion of the beater 5.

Some models of drum pedals and hi-hat stands are available which use a hard, non-flexible connecting link to avoid the problem of slack. However, playing these models feel very different from those with a flexible connection, and many musicians prefer the feel and sound of the flexible connection in most playing conditions.

Figure 6A:
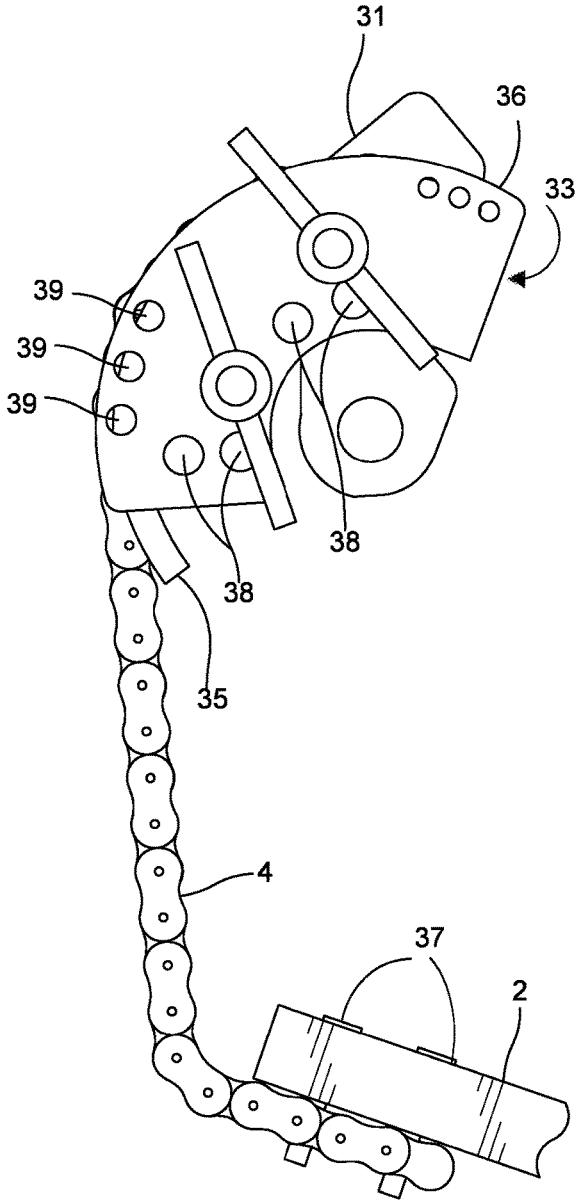
FIG. 6A is a side view of the track hub and chain portion of the drum pedal, in a neutral position.
Figure 6B:
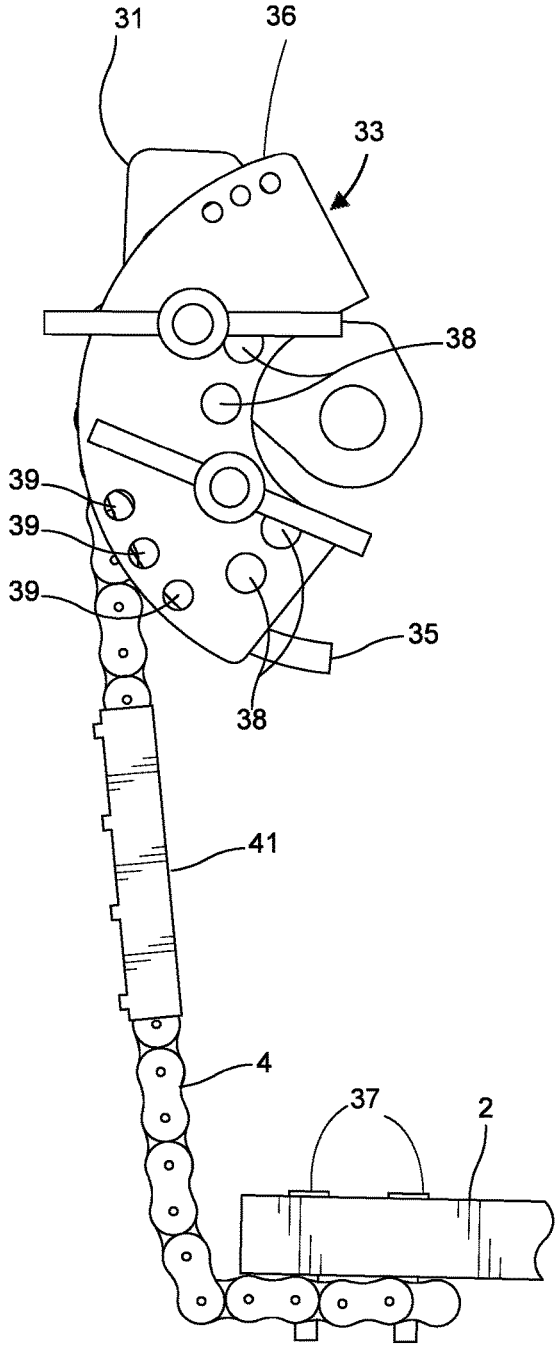
FIG. 6B is a side view of the track hub and chain portion of the drum pedal, in a position where the footboard is depressed and the axle is rotated such that the beater approaches the drum.
Figure 7A:
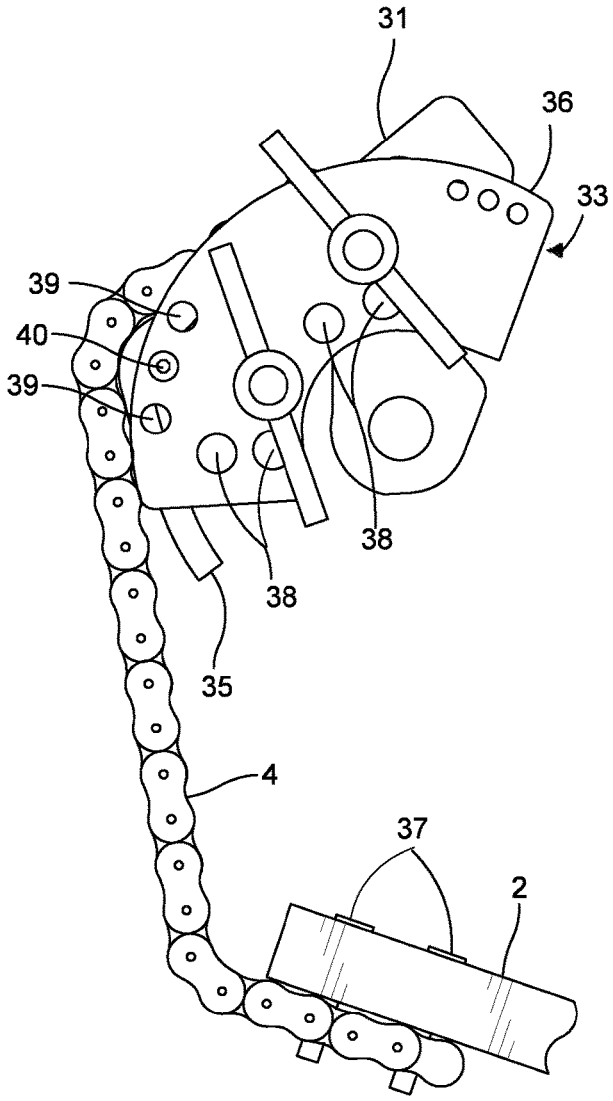
FIG. 7A is a side view of the track hub and chain portion of the drum pedal with fastener installed on the cam, in a neutral position.
Figure 7B:
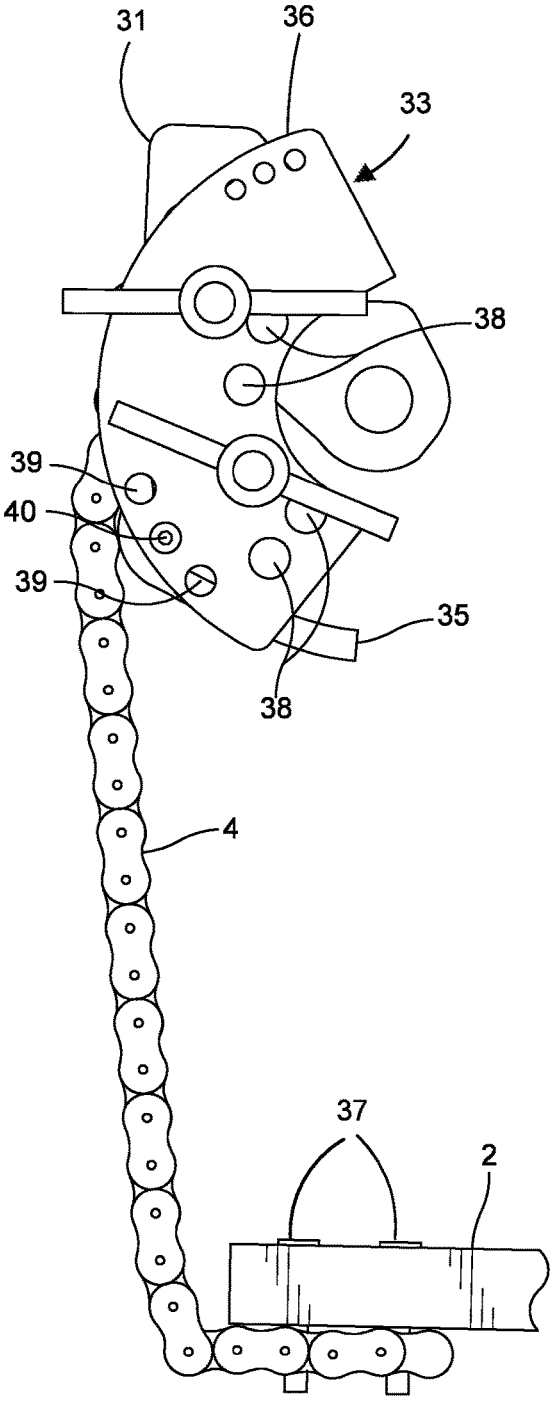
FIG. 7B is a side view of the track hub and chain portion of the drum pedal with fastener installed on the cam, in a position where the footboard is depressed and the axle is rotated such that the beater approaches the drum.

To temporarily make the connector 4 non-flexible, and eliminate the problem of slack, a stiffener 41 may be removably attached to the portion of the connector 4 which does not travel over the track hub 33 of the drum pedal or into the main vertical support member 27 of the hi-hat stand. An exemplary stiffener 41 is shown in FIG. 6B. The stiffener 41 may be as simple as two lengths of flat stock, one length attached to each side of the connector 4, with bolts passing through the stock and the connector 4, thus securing the stock to the connector 4.

Figure 8:
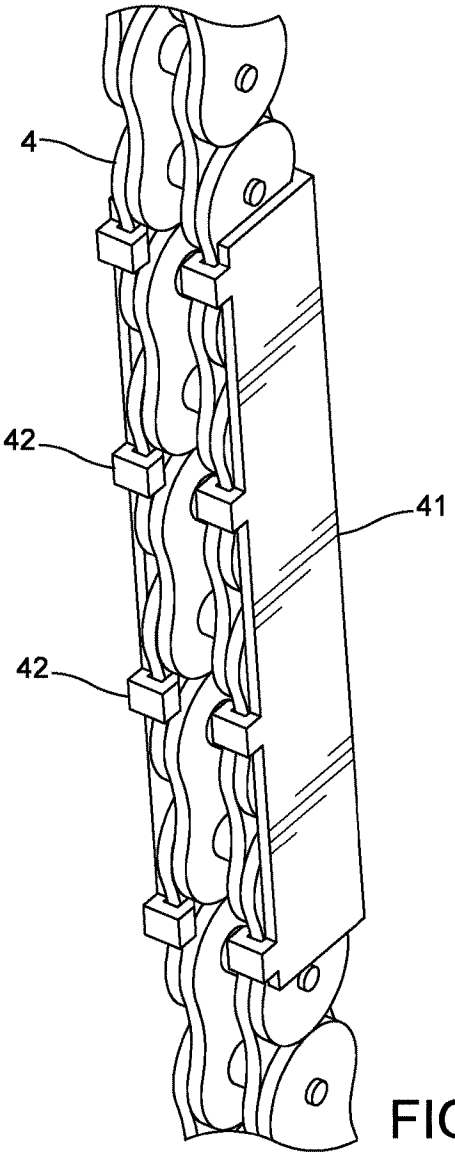
FIG. 8 is an oblique view of an exemplary stiffener attachment which fastens around the lower portion of the drum pedal chain with a claw-like design.

An exemplary embodiment of the stiffener, shown in FIG. 8, consists of a rigid C-channel member 41, with multiple pairs of claws 42 that protrude from and reach around the long open edges of the C-channel member 41 and grab the edges of the chain links 4 around the outside. This claw embodiment 41 of the stiffener is configured to be snapped onto the chain 4, and covers a length of the chain 4 on three sides.

Figure 9:
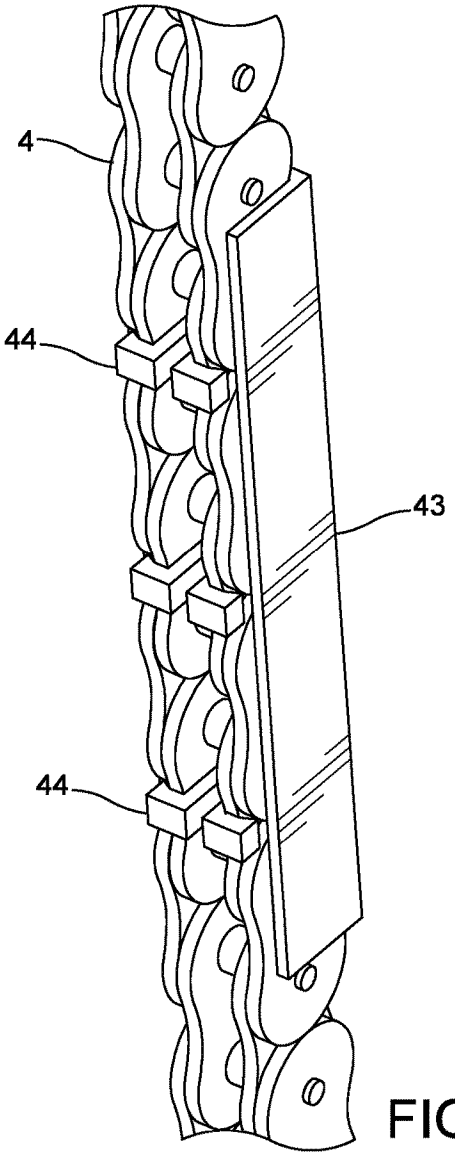
FIG. 9 is an oblique view of an exemplary stiffener attachment which fastens around and through the lower portion of the drum pedal chain with a reverse claw-type design.

A second exemplary embodiment of the stiffener, shown in FIG. 9, consists of a rigid C-channel member 43, with multiple pairs of reverse claws 44 that protrude from the central backbone portion of the C-channel member 43 through a plurality of the chain links 4. This reverse claw embodiment 43 of the stiffener is configured to be snapped onto the chain 4, and covers a length of the chain 4 on three sides.

Figure 10:
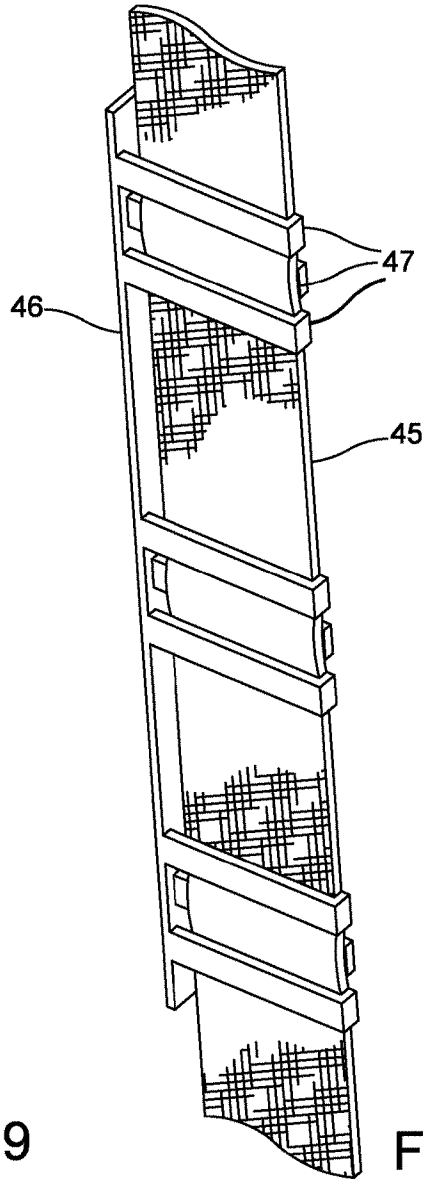
FIG. 10 is an oblique view of an exemplary stiffener attachment which fastens around the lower portion of the drum pedal strap with a clip design.

A third exemplary embodiment of the stiffener, shown in FIG. 10, is configured to be used with a flexible strap 45, rather than a chain, and consists of a length of flat stock 46 with multiple clips 47 protruding outwards. This clip embodiment 46 of the stiffener is configured to be clipped onto the strap 45, and covers the strap 45 on one edge.

Each of the stiffener embodiments may be easily attached to or detached from the chain 4 or strap 45 of a drum pedal or hi-hat stand, so as to switch between a flexible and non-flexible playing configuration.

It will therefore be appreciated that the above-described invention provides multiple adjustments, both mechanical and pneumatic, which enable a user to customize or fine-tune the drum pedal assembly to a degree heretofore unattainable in conventional pedal return mechanisms.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An improvement to a pneumatic return mechanism of a pedal assembly for a musical instrument, said pedal assembly comprising:

a frame supporting a pedal for movement about a first axis, wherein said pedal has a first end and a second end, and wherein said frame is located adjacent to the said first end of the pedal;

a musical component operatively connected to the second end of the pedal remote from said first end, said component being supported for movement in a first direction responsive to movement of said pedal from a first neutral position; and pneumatic means responsive to movement of said pedal in said first direction to return said pedal to said neutral position, wherein said pneumatic means comprises a compression chamber, a diaphragm having a shape, a perimeter, a thickness and a durometer value, a piston rod, and a piston having a shape and an outer surface;

said improvement comprising:

wherein said outer surface of said piston is spherical or semi-spherical in shape; and wherein said diaphragm has a shape which is flat and planar, or generally paraboloid and bowl-shaped.

2. The improvement to a pneumatic pedal assembly of claim 1, wherein said diaphragm is made of polyurethane with a thickness of between 0.5 and 2.5 mm, and a durometer value of between 40 A and 80 A.

3. The improvement to a pneumatic pedal assembly of claim 1, wherein said diaphragm is made of polyurethane with a thickness of 1.5 mm and a durometer value of 60 A.

4. An improvement to a pneumatic return mechanism of a pedal assembly as defined in claim 1, wherein said musical component is supported for rotation on a first hub mounted on an axle for rotation about a second axis, and wherein said piston rod is adjustably directly attached with exactly one stiff segment to a second hub mounted for rotation on said axle.

5. An improvement to a pedal assembly of a musical instrument, said pedal assembly comprising:

a frame supporting a pedal for movement about a first axis located adjacent one end of the pedal; and a musical component operatively connected to a second end of the pedal remote from said first end, said component being supported for movement in a first direction responsive to movement of said pedal from a first neutral position;

wherein said musical component is supported for rotation on a first hub mounted on an axle for rotation about a second axis; and wherein said first hub is an improved cam which has a first shape, two flat sides, a groove containing a track, and one or more pairs of holes passing through the said flat sides and across the said groove of said cam, and each said pair of holes is configured to receive a bump fastener; and wherein a flexible connector connects said second end of the pedal to said improved cam, and part of which connector rests within and along the said groove and track; and wherein the position of said connector within said groove is altered by said affixed bump fastener or fasteners.

6. An improvement to a pedal assembly of a musical instrument, said pedal assembly comprising:

a frame supporting a pedal for movement about a first axis located adjacent one end of the pedal; and a musical component operatively connected to a second end of the pedal remote from said first end, said component being supported for movement in a first direction responsive to movement of said pedal from a first neutral position;

return means responsive to movement of said pedal in said first direction to return said pedal to said neutral position; and a flexible connector connecting said second end of the pedal to said musical component, said connector having a length;

said improvement comprising a stiff member with a length and a shape, which removably attaches along a portion of said connector, which portion comprises less than the whole length of the connector, so as to prevent bending of said connector along the portion of said connector where said member is attached.

7. The improvement to a pedal assembly of a musical instrument of claim 6, wherein the shape of said member is a C-channel with a central backbone and two sides with long open edges, and wherein a plurality of claws protrude from and reach around said long open edges, and which claws are configured to removably attach around the outside of the connector which is a chain.

8. The improvement to a pedal assembly of a musical instrument of claim 6, wherein the shape of said member is a C-channel with a central backbone and two sides with long open edges, and wherein a plurality of claws protrude from said central backbone in the same direction as the said two sides, and which claws are configured to reach through and removably attach to the connector which is a chain.

9. The improvement to a pedal assembly of a musical instrument of claim 6, wherein the shape of said member is a flat stock with clips extending from said flat stock, which clips are configured to reach across and removably attach around said connector which is a strap.

* * * * *